US006755770B2

(12) United States Patent
Martens

(10) Patent No.: US 6,755,770 B2
(45) Date of Patent: Jun. 29, 2004

(54) WEIGHT LIFTING EXERCISE MACHINE FOR USE WITH DUMBBELL WEIGHTS

(76) Inventor: Philip S. Martens, 3401 NE. Lincoln St., Minneapolis, MN (US) 55418

( * ) Notice: Subject to any disclaimer, the term of this patent is extended or adjusted under 35 U.S.C. 154(b) by 149 days.

(21) Appl. No.: 09/923,110

(22) Filed: Aug. 6, 2001

(65) Prior Publication Data

US 2002/0028733 A1 Mar. 7, 2002

Related U.S. Application Data

(60) Provisional application No. 60/223,945, filed on Aug. 9, 2000.

(51) Int. Cl.[7] ..... A63B 21/072
(52) U.S. Cl. ..... 482/99; 482/98; 482/107
(58) Field of Search ..... 482/101–108, 482/98, 103, 99, 908; D21/197

(56) References Cited

U.S. PATENT DOCUMENTS 491,326 A * 2/1893 Whitney
776,824 A * 12/1904 Bryon, Jr.
5,184,992 A * 2/1993 Banks
5,637,064 A * 6/1997 Olsen et al.
5,725,459 A 3/1998 Rexach
6,582,346 B1 * 6/2003 Lines et al.

FOREIGN PATENT DOCUMENTS

FR 2731347 A 3/1996
GB 2162434 A 2/1986

* cited by examiner

*Primary Examiner*—Jerome W. Donnelly
(74) *Attorney, Agent, or Firm*—Robert W. Gutenkauf; Gray Plant Mooty Mooty & Bennett, P.A.

(57) ABSTRACT

A weight lifting exercise machine that uses dumbbell weights for the weight resistance and for incremental weight adjustment. Dumbbells are particularly suitable since they are usable both as free weights and as incremental weights for the exercise machine. The machine includes an overall frame that stands on the floor, and at least one vertical guide rail attached to the frame. A dumbbell weight carrier is a assembled to the guide rail. The dumbbell weight carrier has a carriage that engages the guide rail. A dumbbell receptacle is attached to the carriage. The dumbbell receptacle can hold a plurality of dumbbell weights selected according to the overall weight desired by the exercising person. A weight handle is connected to the dumbbell weight carrier. The exercising person engages the weight handle and moves it against the weight resistance of the weight carrier and dumbbell weights loaded thereon.

9 Claims, 11 Drawing Sheets

WEIGHT LIFTING EXERCISE MACHINE FOR USE WITH DUMBBELL WEIGHTS

CROSS REFERENCE TO RELATED APPLICATION

This application claims the benefit of U.S. Provisional Patent Application Serial No. 60/223,945 of Philip Martens filed Aug 9, 2000.

BACKGROUND OF THE INVENTION

The benefits of weight lifting exercises in terms of building and maintaining strength, body toning, and general health and endurance, are well known. Free weights are frequently used. Free weights include barbells and hand weights known as dumbbells. The classic dumbbell is a weight exercise device with a short hand grip or bar connected to weights at either end. The dumbbell is meant for use with a single hand. The weight is usually fixed but is sometimes adjustable through addition or subtraction of increments of weight. A dumbbell inventory typically includes pairs of dumbbells of various weights ranging from one to twenty pounds or more. Another type of dumbbell is the block style dumbbell of the type sold under the trademark Powerblock®.

Weight training machines are frequently used in addition to, or instead of, free weights. The weight training machine safely mimics, to some extent, barbell-type weight lifting. It also permits the user to engage in types of weight resistance exercises not available through the use of free weights alone. The "weight" resistance of the machine is provided by means of a stack of weights, springs, elastic bands, shock absorbers, or even the user's own body weight.

The preferred resistance structure for such machines is weights. These take the form of several hundred pounds of stacked weights that are dedicated to the singular purpose of providing resistance for the weight training machine. The weights are permanently or semi-permanently attached to the remainder of the machine. This makes the machine heavy and hard to move. The weight increments are relatively large, whereby a user may tend to overload, which can lead to injury. The weights add to the expense of the machine, even while an inventory of dumbbell weights may be available. The machine weights can contribute to stress on the floor or other supporting surface.

The other resistance means indicated are generally less desirable than weights but are preferred where either cost and/or weight are factors. For example, in home units, cost is generally considered a factor to the purchaser, and weight becomes a factor in shipping the unit and in subsequent storage by the user. Elastic bands wear out. Springs will fatigue. As is the case with a spring, the resistance offered by an elastic band is not constant but varies proportionate to the amount of deflection. Adjustment ability is limited.

SUMMARY OF THE INVENTION

The invention pertains to a weight lifting exercise machine that employs dumbbells for the weight resistance and for incremental weight adjustment. Dumbbells are particularly suitable. They are often available at the exercise location for free weight exercise use, typically in equal weight pairs. Typically the weight range of dumbbells is three pounds to one hundred pounds, although it can be more. The use of dumbbells or other hand weights on the weight lifting machine of the invention eliminates the need for a separate stock of dedicated machine weights.

The weight lifting machine includes an overall frame that stands on the floor, and at least one upright support post or guide rail. A dumbbell weight carrier is assembled to the guide rail for up and down movement. The carrier includes one or more receptacles to engage the dumbbells, and a carriage connected to the receptacles for movement on the guide rail. Dumbbells can be loaded and unloaded on the dumbbell carrier. The carrier can be connected to a cable, such as a wire rope, a chain or combination thereof. The other end of the cable is connected to a weight handle to be engaged by the exercising person in lifting or lowering the carrier against gravity. Depending on the configuration of the machine, the weight handle is engaged by the hands, feet, legs or the like, to accomplish an exercise routine. In doing so, the weight carrier is lifted and lowered along the guide rail.

In one form of the invention, the weight handle is connected to the carrier through a pulley system of one or more pulleys that conveniently position the weight handle relative to the user, for example, proximate a bench. The carrier will typically be adapted to carry dumbbells and have a bracket to receive and hold a plurality of dumbbells. There may be one or more dumbbell carriers that move on one or more guide rails. A second weight handle may be connected to the carrier for versatility of the machine.

The weight lifting machine can include a bench to support the user, lying or sitting, while engaging the weight handle in a pulling action against the weight resistance. The bench can optionally be pivotally connected to the machine frame so as to be folded into the overall frame of the machine during non-use to save room. In another form of the invention, the user engaging the weight handle lifts against the weight resistance, as when doing squats or military presses.

DESCRIPTION OF PREFERRED EMBODIMENTS

Figure 1:
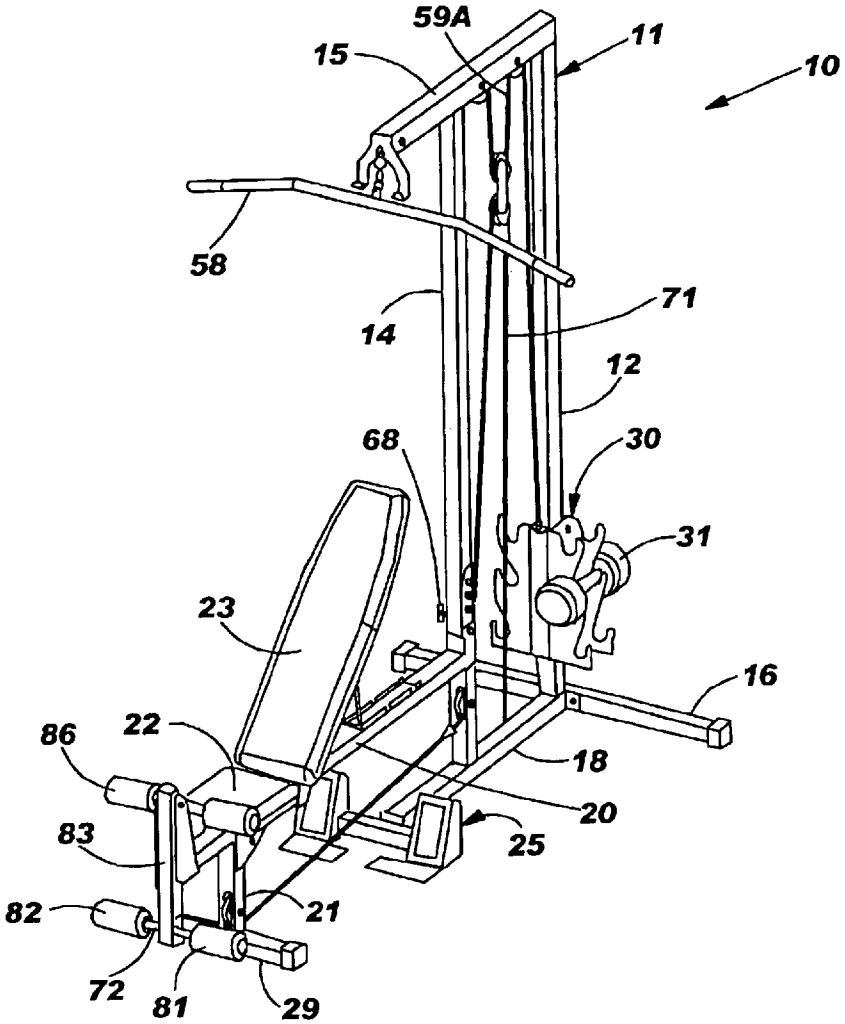
FIG. 1 is a front perspective view of one form of a weight lifting exercise machine according to the invention.
Figure 2:
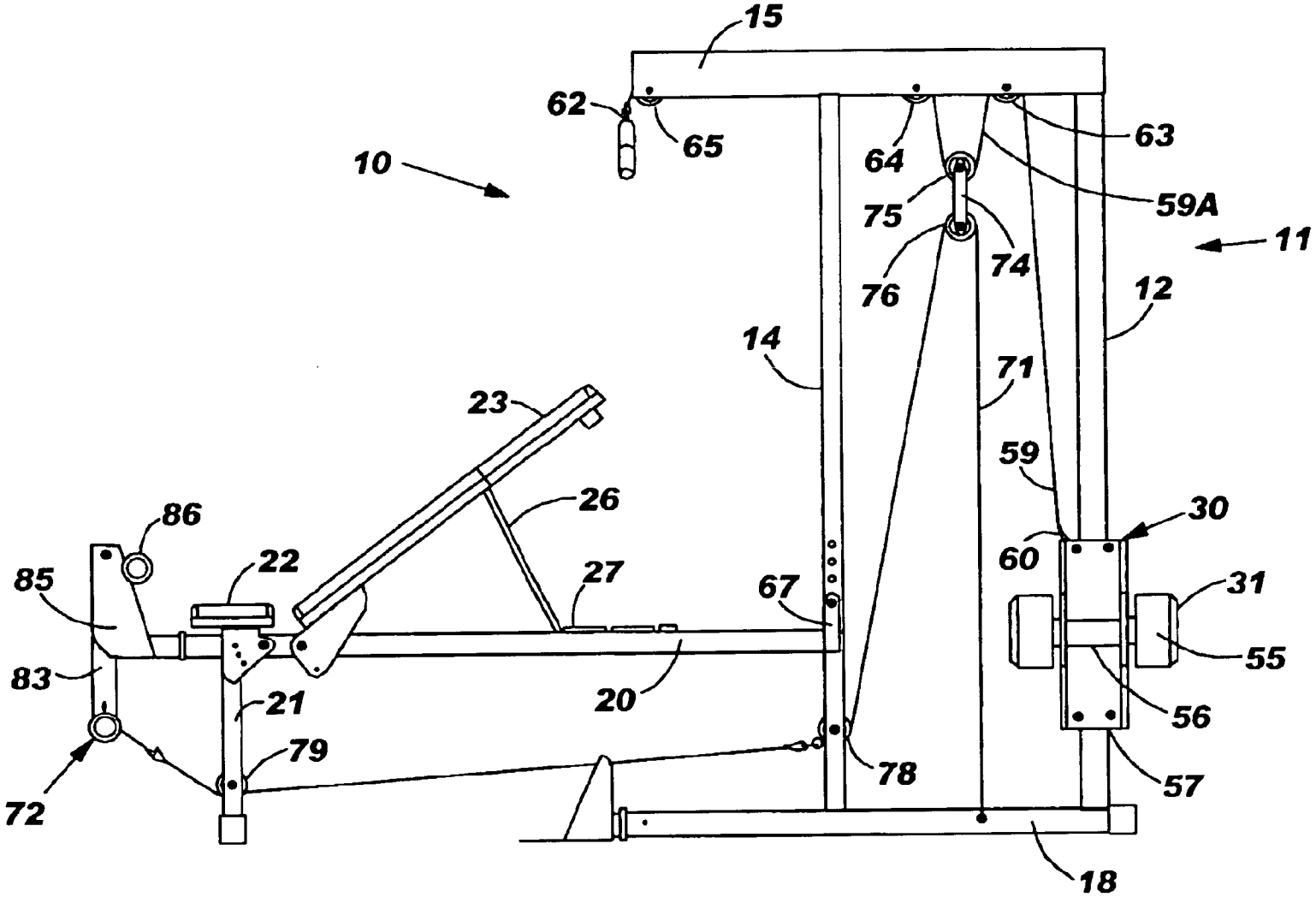
FIG. 2 is a side plan view of the weight lifting exercise machine of FIG. 1.
Figure 3:
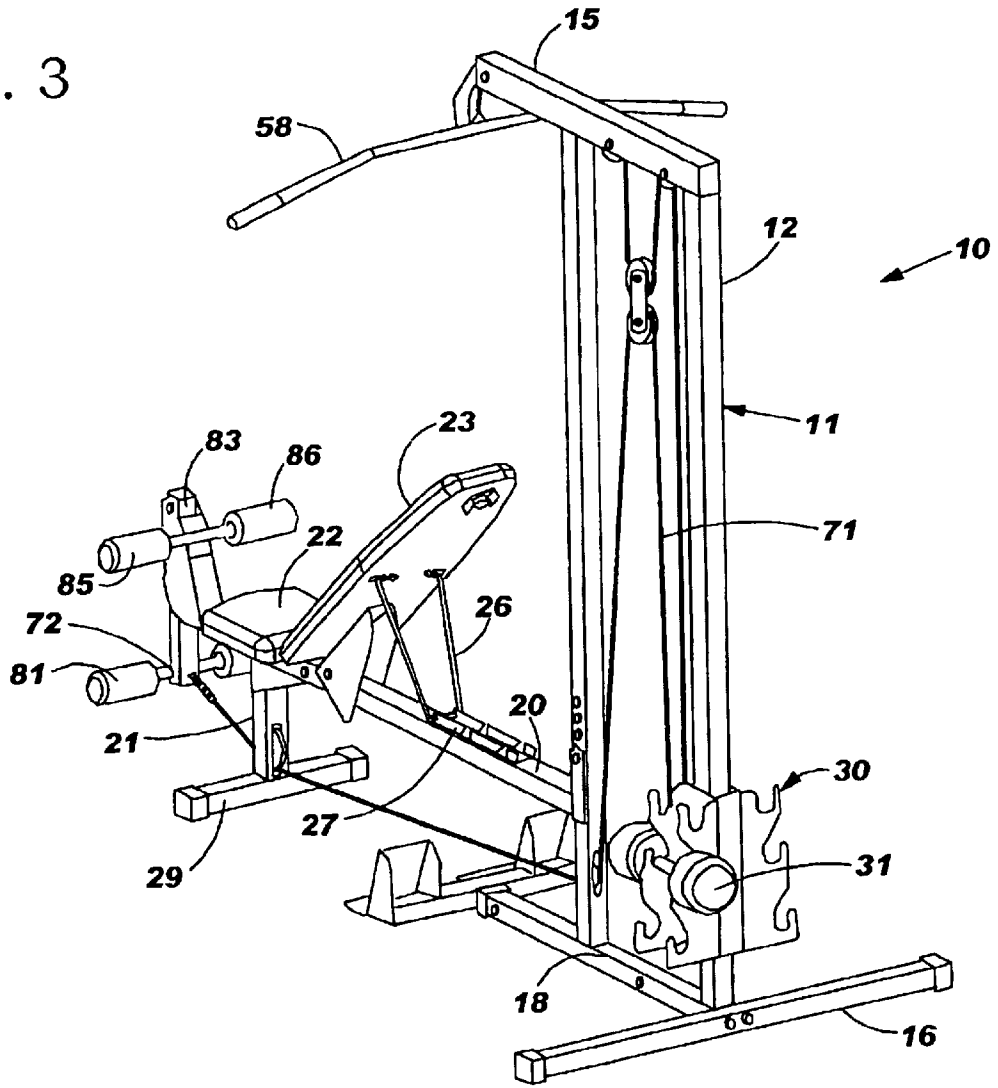
FIG. 3 is a rear perspective view of the weight lifting exercise machine of FIG. 1.

Referring to the drawings, there is shown in FIGS. 1 through 3 a weight lifting exercise machine according to one form of the invention, indicated generally at 10. Machine 10 has an overall frame 11 with a first upright member comprised as a support and guide rail 12; and a second upright front support member 14. An overhead beam 15 connects the upper ends of the support members 12, 14 and overhangs the front support member 14. A frame stand includes a horizontal lateral leg 16 connected to a longitudinal horizontal leg 18 in a "T" shape. The lower ends of the support members 12, 14 are connected to the longitudinal leg 18. A foot brace 25 is assembled to the end of the leg 18 opposite its connection to the lateral leg 16.

An exercise station includes an horizontal bench support beam 20 pivotally connected to and extending forward from the lower portion of the second upright structural member 14. The outer end of the support beam 20 is connected to a vertical leg 21 attached to a horizontal leg 29. A weight bench includes a seat 22 attached to the support beam 20, and a backrest 23. Backrest 23 is positioned adjacent to seat 22 and is connected at one end to a hinge structure 24 so that it can be pivoted up and down, or from the upright position shown in FIGS. 1 through 3, to a flat horizontal position. The back rest 23 is held upright by a U-shaped rod 26 that interconnects with notches in a positioning bracket 27.

A dumbbell carrier is assembled to the guide rail 12 for up and down sliding movement on the guide rail. As shown in FIGS. 1 through 3, carrier 30 carries a dumbbell weight 31. The structure of carrier 30 is more particularly shown in FIGS. 4 and 5. The carrier 30 has dumbbell racks or receptacles comprised as a pair of brackets 33, 34 positioned in back to back relationship and separated by a carriage structure. Each bracket has a plurality of openings for receipt of the bar of a dumbbell. First bracket 33 has side plates 35, 36 connected by a back plate 38. A first side plate 35 has a series of vertically spaced, hook-shaped edge openings 39A, 40A, 42A. Second side plate 36 has a corresponding plurality of edge openings 39B, 40B, 42B. Each of the edge openings defines a pocket for receipt of a section of a dumbbell bar. The bar of the dumbbell is engageable in a pair of corresponding openings. A plurality of such bars can be accommodated by each bracket. The openings are upwardly open and hook-shaped to inhibit unintended disengagement of the bar from the bracket. The second bracket 34 similarly has side plates 43, 44 and a back plate 46. The second bracket 34 also has a plurality of hook-shaped edge openings arranged in corresponding pairs.

The first and second carrier brackets 33, 34 are connected to a carriage structure for movement up and down the guide rail 12. This carriage structure includes the backplates 38, 46 of the brackets 33, 34, and sidewall structures 47, 48. Each of the sidewall structures 47, 48 includes a channel shaped member connected to the backplates 38, 46 of brackets 33, 34 by nut and bolt assemblies 50. The backplates and sidewall structures form a guide opening 54 that is slightly oversized with respect to the cross-sectional dimensions of the guide rail 12. This permits up and down sliding movement of the dumbbell carrier 30 on the guide rail 12. Downward movement of the carrier 30 is stopped by stop members 57.

Figure 6:
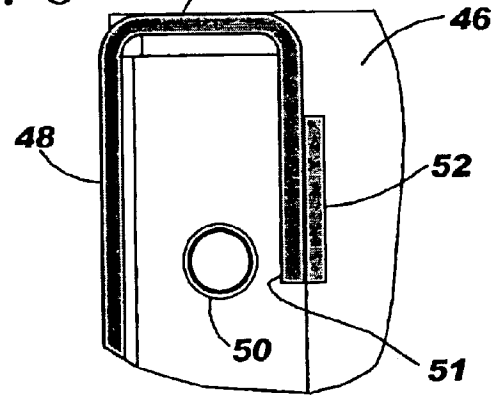
FIG. 6 is an enlarged sectional view of a portion of the dumbbell carrier of FIG. 5 taken along the line 6—6 thereof.

Means can be provided, if necessary, to facilitate movement of the carrier 30 on guide rail 12, such as rollers, grease, or the like. As shown, pads of low friction material are in place to facilitate movement of carrier 30 on rail 12. Referring to FIG. 6, sidewall structure 48 has an end wall 49 and a short overlapping interior wall 51. A slide pad 52 of Teflon® or similar low friction material is fastened to interior wall 51 in confronting relationship to rail 12. In like fashion, slide pads 53 are fastened to the interior surfaces of the back plates 38,46 of brackets 33,34.

Figure 4:
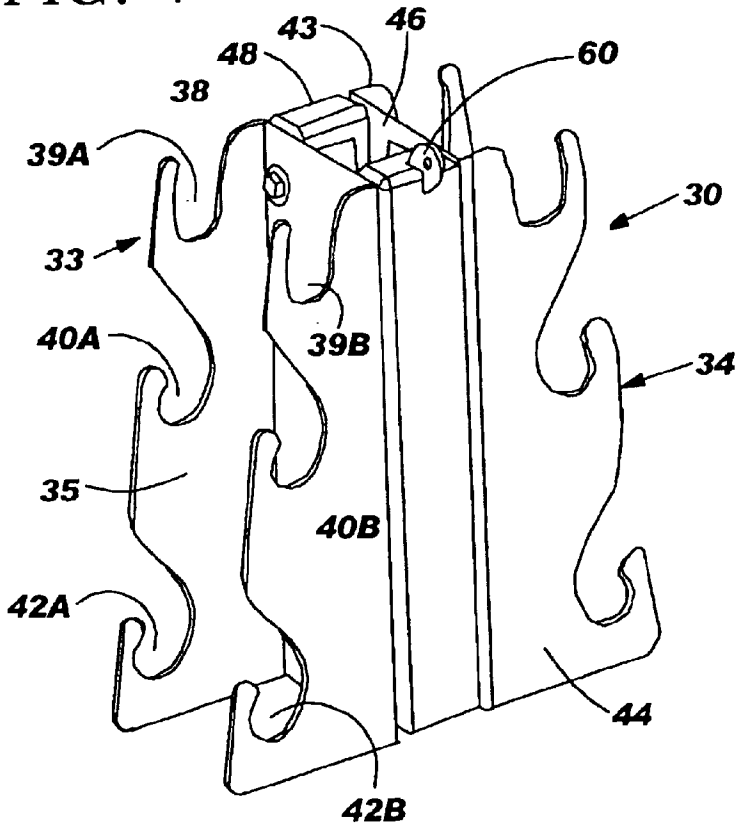
FIG. 4 is a perspective view of the dumbbell carrier of the weight lifting exercise machine of FIG. 1 with a portion broken away for purposes of illustration.
Figure 5:
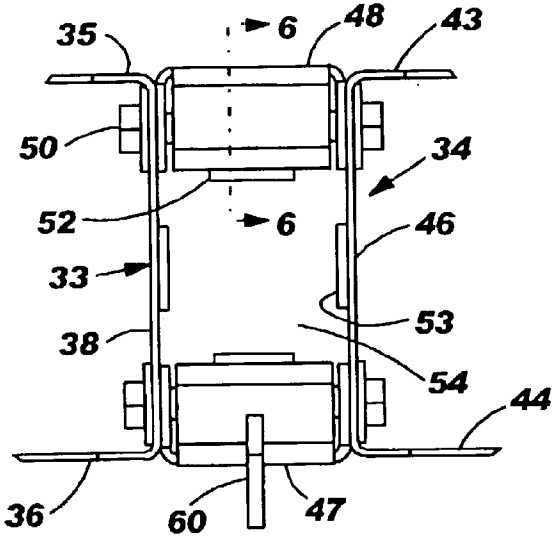
FIG. 5 is a top view of the dumbbell carrier of FIG. 4.

As shown in FIG. 2, the standard dumbbell 31 has end weights 55 connected by a dumbbell bar 56. The hook-shaped openings or pockets 39, 40, 42 are adapted to secure the dumbbell bar 56 in place. A number of dumbbells can be stacked in the bracket. As shown in FIG. 4, the carrier can accommodate six dumbbells, three in each bracket. More or less could be provided. Dumbbells of various weights can be loaded on to the carrier 30 according to the exercise prerogative of the user. For example, two forty-pound dumbbells can be loaded onto the carrier 30, along with two ten-pound dumbbells and one five-pound dumbbell for a total loaded weight of 105 pounds plus the weight of the carrier 30. Weight increments can be added and subtracted according to the weights of the various dumbbells available.

Referring again to FIGS. 1 through 3, a main weight handle 58 is connected to the carrier 30 so that movement of the weight handle 58 moves the carrier 30 against the influence of gravity. The connection between the weight handle and the carrier can be a system of levers, linkages, cables, belts, a combination thereof, or other such connecting means capable of transmitting a tension force. In the embodiment shown in FIGS. 1 through 3, the weight handle is connected to the carrier 30 through a cable and pulley system. The cable can be wire, rope, chain, or the like or any combination thereof, capable of transmitting a tension force.

The weight handle is readily detachable and interchangeable with other weight handles. For example, another weight handle can be shorter, or fashioned of rope. A weight handle could be fashioned as a head harness for neck exercise, or as a harness to fit other body parts according to the specialized exercise routine.

A main cable 59 is fastened at one end to an eye clip 60 that is attached to the carrier 30 (FIG. 4). The other end of main cable 59 is fastened to another eye clip 62 that is centrally attached to the weight handle 58. The intermediate segment of main cable 59 is trained over a pulley system which includes first, second and third pulleys, 63, 64 and 65, that are mounted in the overhead beam 15. The overhead beam 15 can be a box beam with downwardly open slots so that pulley axles can be mounted between the sidewalls and carry pulleys as shown. The beam 15 extends forward from the front support member 14. The weight handle 58 is positioned off of the forward tip of overhead beam 15 where it can be pulled away from overhead beam 15 in an action that lifts the carrier 30 along the guide rail 12. Return movement of the weight handle 58 is stopped by the overhead beam 15.

Bench support beam 20 is removable from the overall frame 11 when not in use in order to provide clearance for the exercising person so approach the weight handle 58 standing. The inside end of beam 20 has a bracket 67 that engages a segment of the second support member 14 of frame 11. A pin 68 passes through aligned holes in the bracket 67 and support member 14 to secure the beam in place. The support beam is removable simply by removal of the pin 68 and moving the beam 20 away from the frame. Additionally, bench support beam can be pivoted upwardly about pin 68 as shown and described with respect to FIG. 3A.

A secondary weight handle system lends versatility to the machine 10. A secondary cable 71 is connected at a fixed end to frame 11 as at leg 18 of the frame stand. The opposite end of secondary cable 71 is connected to a second weight handle 72. A pulley block 74 carries an upper pulley 75 and a lower pulley 76. A segment 59A of the main cable 59 is trained over upper pulley 75. The segment 59A is located between the first and second pulleys 63, 64 of the pulley system of the first weight handle 58. The secondary cable 71 is trained over the lower pulley 76 of pulley block 74. A sixth pulley 78 is mounted at the lower end of the second support post 14 of frame 11. A seventh pulley 79 is mounted in the vertical leg 21 that is attached to the support beam 20. The secondary cable 71 extends from the lower pulley 76 to the sixth pulley 78 and then over the seventh pulley 79 to the connection at the second weight handle 72.

The second weight handle 72 shown in the configuration of FIGS. 1 through 3 is adapted for engagement by the ankles and lower legs of the exercising person. Leg pads 81, 82 are fastened to the ends of the second weight handle 72. The second weight handle 72 is connected to the lower end of a pivot arm 83. Pivot arm 83 is pivotally connected to the upper end of a support member 85. The lower end of support member 85 is fastened to the end of the horizontal support beam 20. A padded support bar 86 is also connected to the support member 85.

Figure 3A:
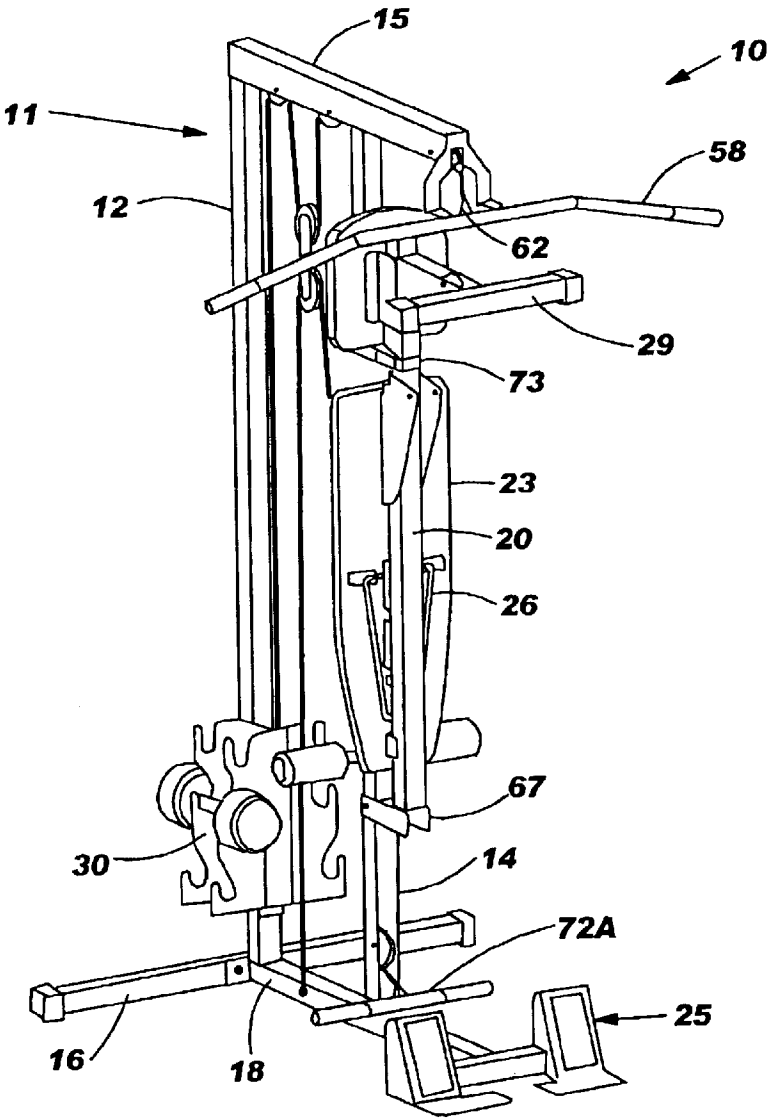
FIG. 3A is a view of the exercise machine of FIGS. 1 through 3 showing the seat support beam pivoted up and out of the way.

The second weight handle 72 is engagable by the legs and ankles of the exercising person. The exercising person can be sitting on the seat 22 facing the support member 85. The ankles engage the pads 81, 82 on the second weight handle 72 in a lifting motion. This lifts the carrier 30 through the secondary cable 71. Alternatively, the exercising person can stand facing the machine and engage the back of the ankle on one of the pads 81, 82 one leg at a time. From FIGS. 1 through 3, it may easily been seen that the second weight handle 72 could be configured to be manually grasped by the exercising person and lifted to mimic lifting a barbell. FIG. 3A shows an embodiment of the invention of the form shown in FIGS. 1 through 3 wherein the bench support beam 20 is pivoted about the pin 68 to a position up against the second support member 14 and out of the way. A strap 73 or other suitable holding structure secures the bench support in the stored position. A secondary weight handle 72A is available at the lower end of the second support member 14. A foot brace 25 is assembled to the end of the leg 18 for use by a sitting exercising person.

Figure 7:
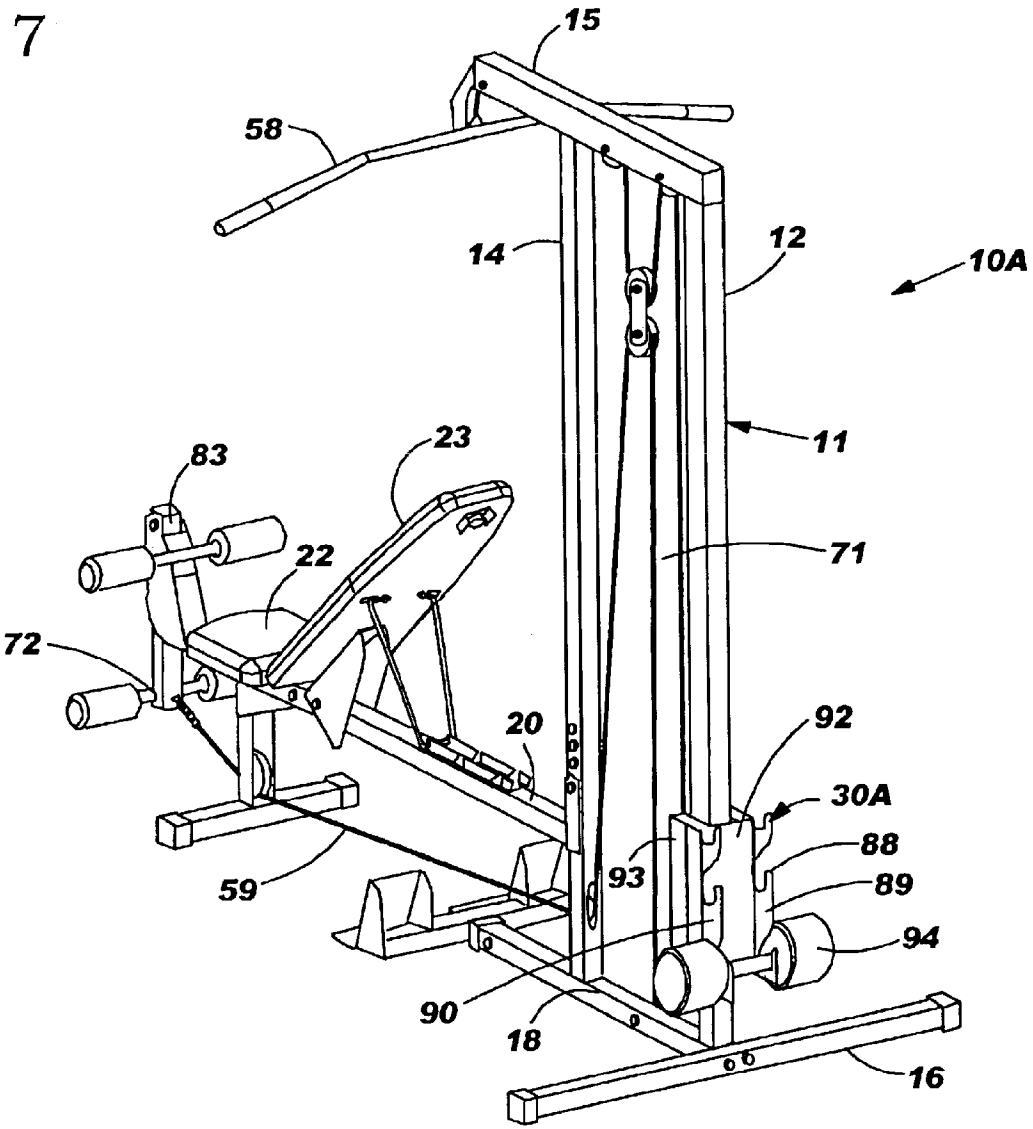
FIG. 7 is a rear perspective view of a weight lifting exercise machine according to another form of the invention.

Another form of the invention is shown in FIG. 7 and indicated generally at 10A. The machine 10A is like the machine 10 shown in FIGS. 1 through 3 with the exception of a modified dumbbell carrier 30A. The machine 10A has a frame 11 including a first upright guide post and rail 12, a second upright support member 14, and an overhead horizontal beam 15. Frame 11 is supported on a stand which includes horizontal legs 16, 18. A support beam 20 carries a seat 22 with a back rest 23. A weight handle 58 is connected through a cable 59 to the carrier 30A. A second weight handle 72 is connected by a secondary cable 71 to the weight carrier 30A for manipulation as described above.

The carrier 30A differs from the carrier 30 in that it only has a single receptacle bracket for engagement of dumbbells. The carrier 30A has a bracket 88 with side plates 89, 90 that have vertically spaced, hook-shaped edge openings arranged in pairs for receipt of dumbbell handles. The bracket 88 has a back plate 92 that together with sidewall structure 93 forms a carriage up and down movement on the guide rail 12. Dumbbells like the dumbbell 94 can be loaded on the carrier 88 according to the weight preference of the exercising person.

Figure 4A:
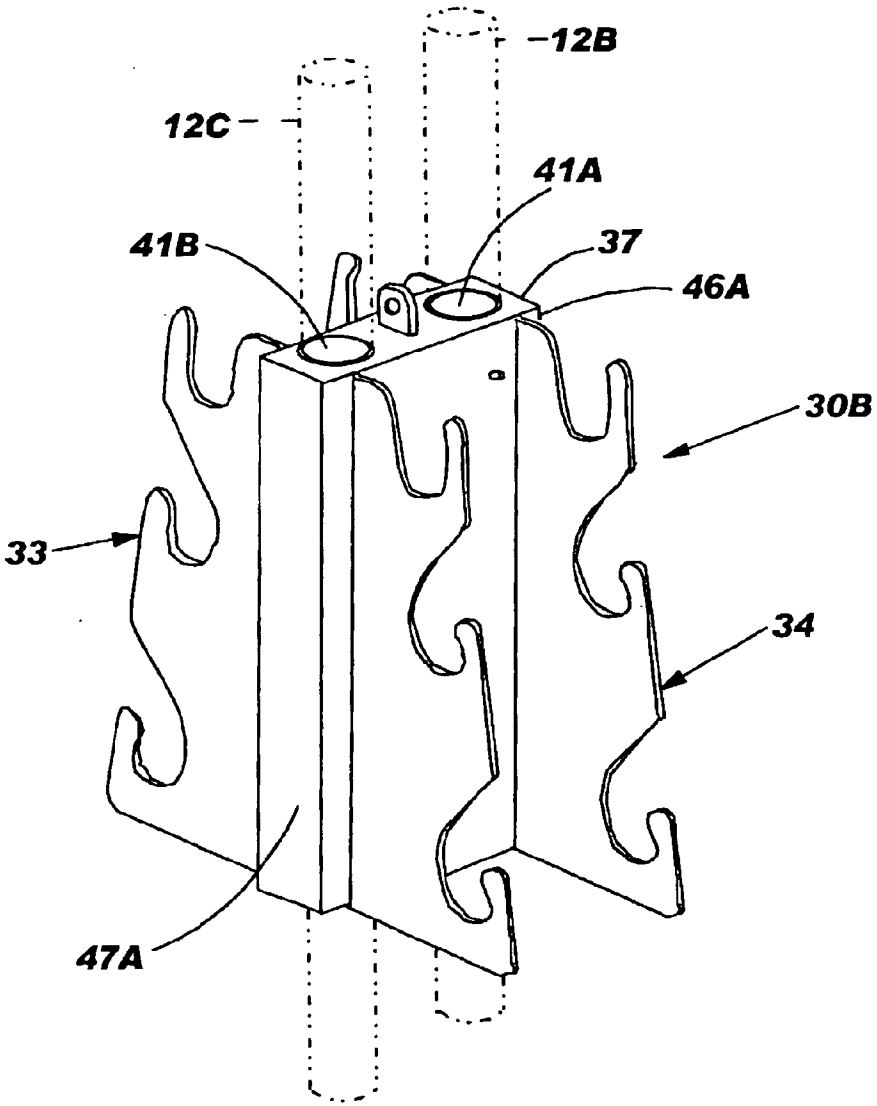
FIG. 4A is a perspective view like that of FIG. 4 showing an alternative dumbbell carrier configuration having two vertical guide rails.

FIG. 4A shows another weight carrier-guide rail configuration wherein two guide rails are provided. Many existing weight machines currently employ a weight system using a pair of parallel guide rails, whereby the present invention can be retrofitted to such machines. The weight carrier is shown generally at 30B and a pair of vertical guide rails are shown in phantom at 12B and 12C. The weight carrier 30B has a top plate 37 fastened between the side walls 46A, 47A. Top plate 37 has a pair of guide rail mounting openings 41A, 41B. The guide rails 12B, 12C are engaged in the openings 41A, 41B for up and down movement of the carrier on the guide rails.

Figure 8:
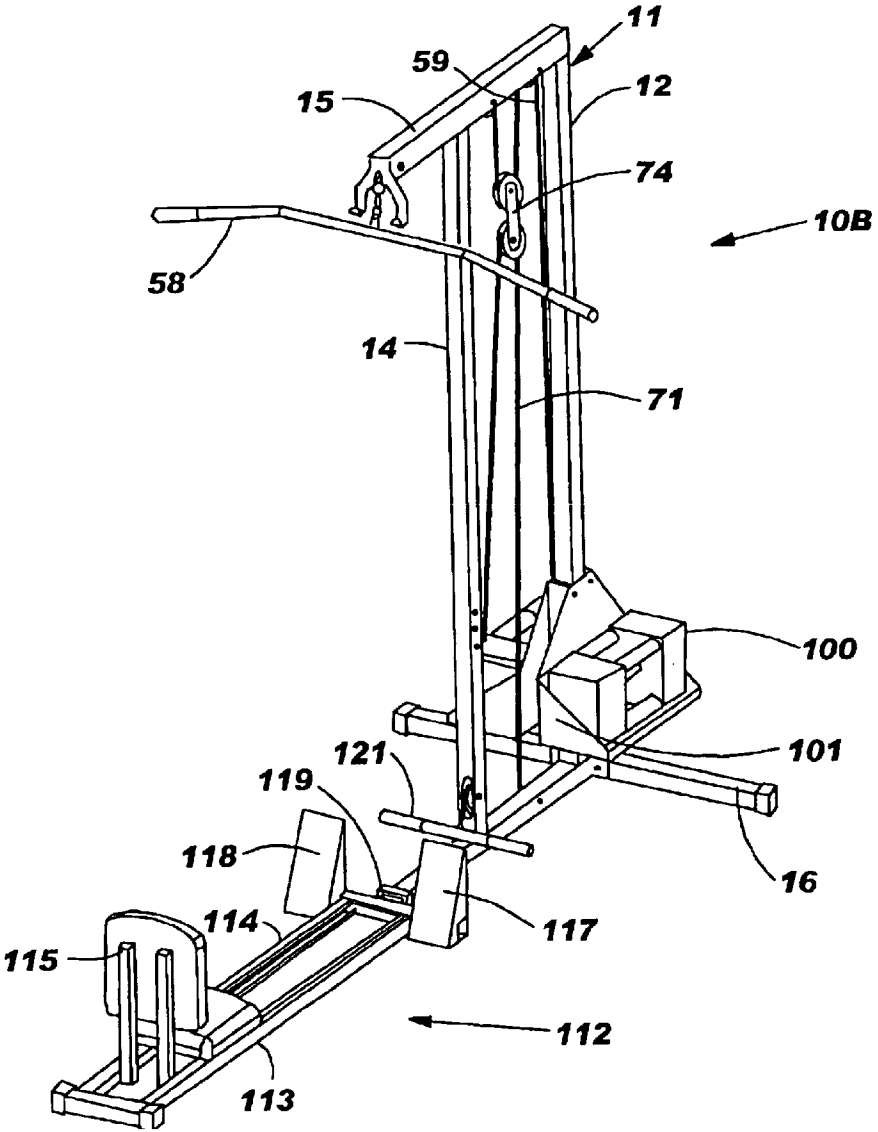
FIG. 8 is a perspective view of a weight lifting exercise machine according to a yet further form of the invention.

FIG. 8 shows a yet further form of the invention indicated generally at 10B. The form of the invention at 10B differs from the earlier form of the invention indicated generally at 10 in FIGS. 1 through 3 in the structure of the dumbbell carrier and in the configuration of the exercise station. Otherwise the machines are the same. Machine 10B has a frame 11 that includes a first support member or guide rail 12 and a second upright support member 14 connected by an overhead beam 15. Legs 16 and 18 stabilize the frame. A dumbbell carrier 30B is connected to the main cable 59 that is trained over pulleys attached to the overhead beam 15 and then to the main weight handle 58.

Figure 9:
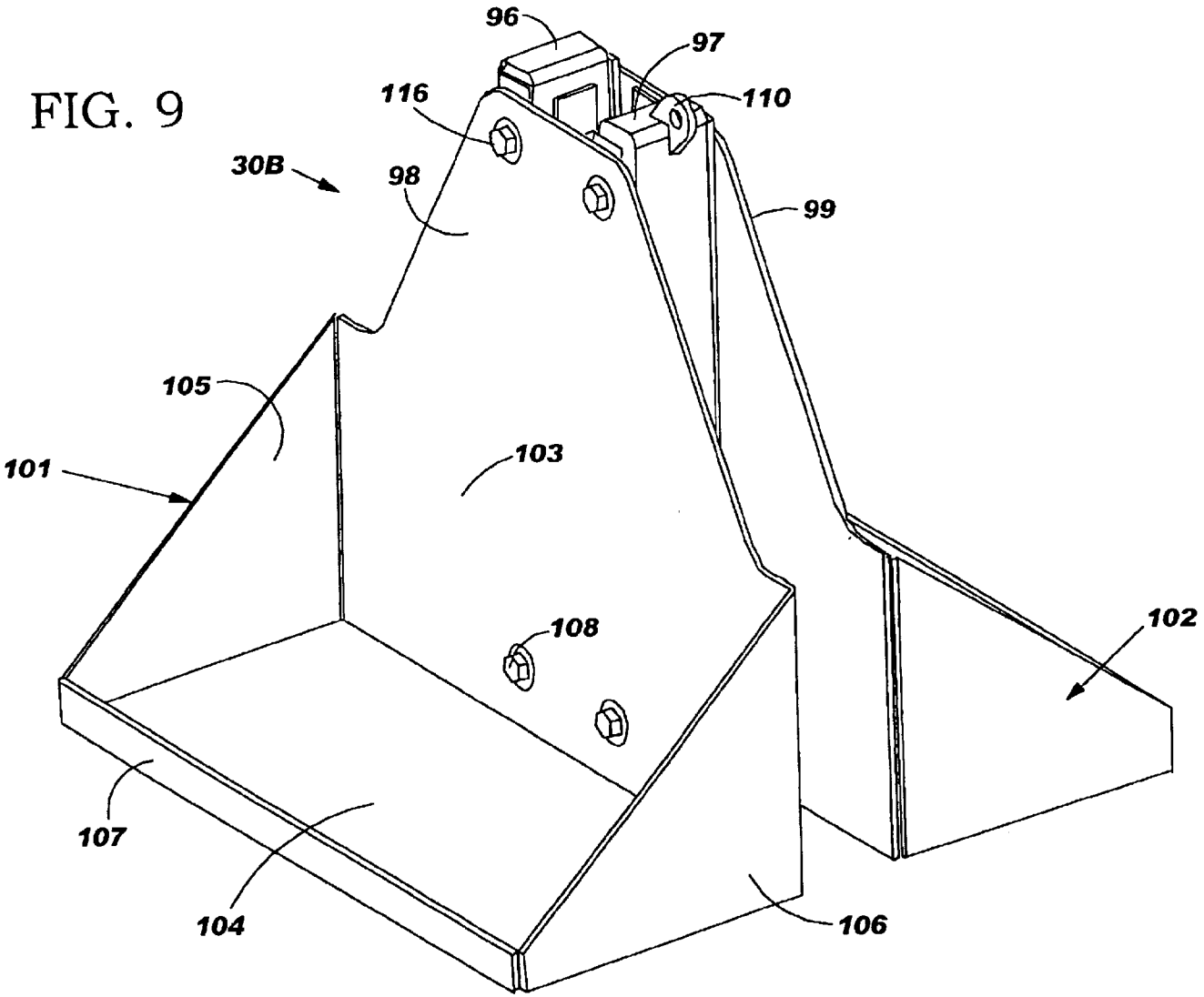
FIG. 9 is a perspective view of the dumbbell carrier of the weight lifting exercise machine of FIG. 7.

The dumbbell carrier 30B is adapted to carry hand weights or dumbbells having a box-like configuration, of the type sold under the trademark Powerblock®. The dumbbell carrier 30B is more particularly shown in FIG. 9. The dumbbell carrier 30B includes a carriage structure to straddle and ride along the guide rail 12. The carriage structure includes lateral side wall structures 96, 97 connected to back plates 98, 99 by bolts 116. A pair of receptacle baskets 101, 102 are connected respectively to the back plates 98, 99. Each basket 101, 102 is adapted to carry one or more of the block style dumbbells 100. For example, the basket 101 has a flat base or tray 104 connected to a back wall 103 which is in turn connected to a back plate 98 by bolts 108. Basket 101 has inclined side walls 105, 106 and a front lip 107 for confining weights placed on the tray 104 of the basket 101. An eye clip 110 is connected to the dumbbell carrier 30B for connection to the main cable 59 of machine 10B.

Referring back to FIG. 8, the exercise station 112 includes a pair of horizontal, parallel tracks 113, 114 and a seat assembly 115 mounted for sliding of movement on the tracks. Seat assembly 115 faces frame 11 and is adapted to travel back and forth on the tracks relative to the frame. Foot supports 117, 118 are mounted at the inward ends of the tracks 113, 114. Suitable connecting structure 119 releasably connects the tracks 113, 114 and the foot supports to the frame 11.

A secondary weight handle 121 is connected to the free end of the secondary cable 71 where it is trained over the pulley 78 assembled in the second frame support member 14. The inward limit of travel of the secondary weight handle 121 is the second support member 14. Pulling on the secondary weight handle 121 away from the frame 11 raises the weight carrier 30B and any weights carried thereon through the secondary cable 71 trained over the pulley block assembly 74.

In use of the machine 10B, the exercising person optionally engages either the main weight handle 58 or the secondary weight handle 121. When engaging secondary weight handle 121, the exercising person is seated on the seat assembly 15 with feet engaging the foot supports 117, 118. The exercising person engages the secondary weight handle 121 and pulls it away from the frame 11, continuing the exercise routine by moving the secondary weight handle 121 away from and toward the frame 11 against the weight offered by the dumbbell carrier 30B. A collection of one or more dumbbells is assembled on the trays of the baskets 101, 102.

Figure 8A:
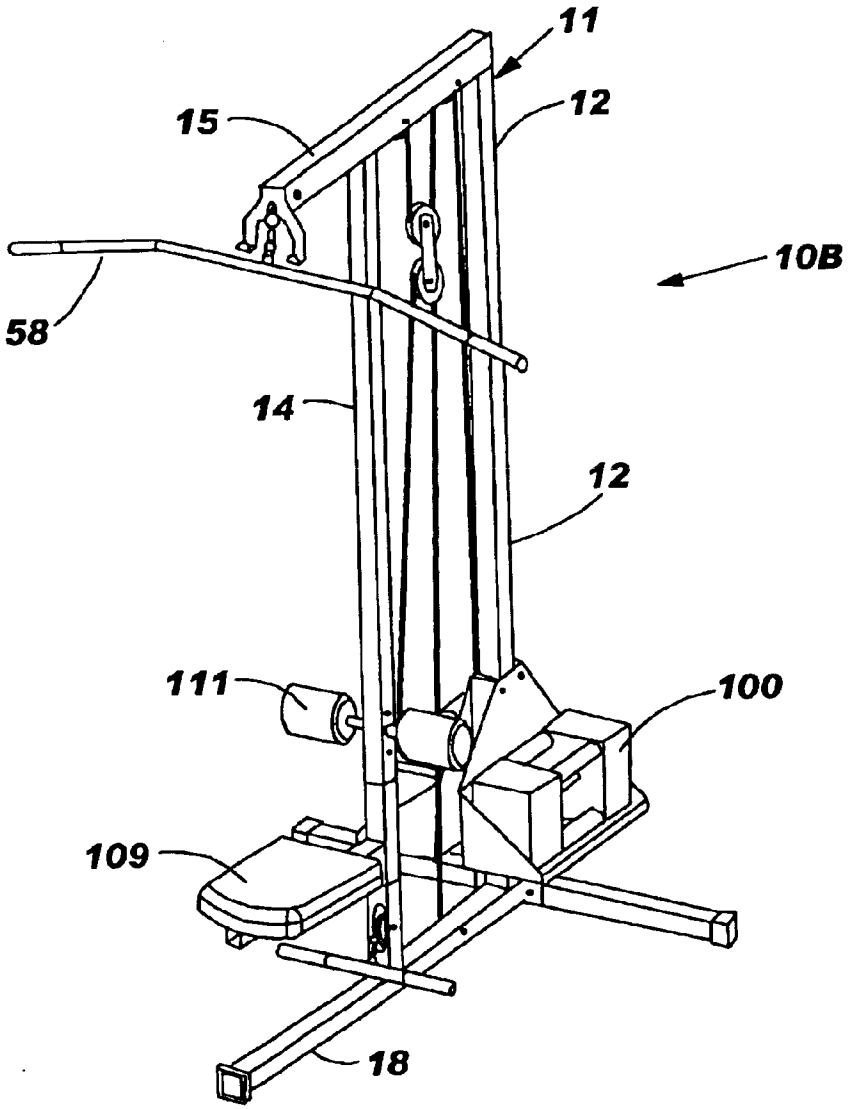
FIG. 8A is a modification of the form of the invention shown in FIG. 8.

FIG. 8A shows a modification of the exercising machine of FIG. 8. The sliding seat assembly has been removed and a short seat assembly 109 has been installed. Short seat assembly is assembled to the second support member 14 beneath the main weight bar 58. Hold down pads 111 are also assembled to the second support member 14 positioned for engagement by the thighs of the exercising person seated on short seat assembly 109 and pulling on weight handle 58.

Figure 10:
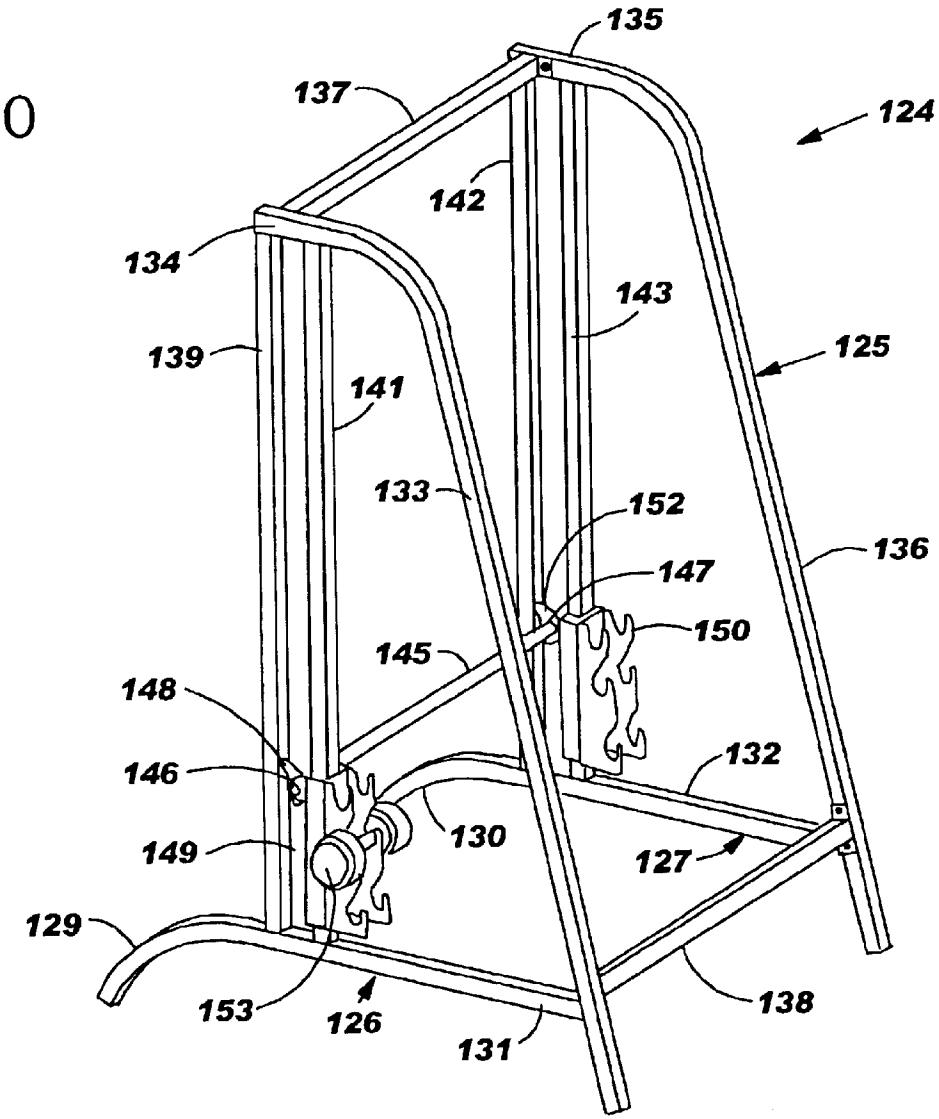
FIG. 10 is a front perspective view of a weight lifting exercise machine according to a still further form of the invention.

A still further form of a weight lifting exercise machine according to the invention is shown in FIG. 10 and indicated generally at 124. The machine 124 includes an overall frame 125 that is relatively tall and open at the front. A stand for frame 125 includes front legs 126, 127 and back legs 133, 136. Each of the front legs 126, 127 has a front foot 129, 130 engaging the supporting surface, and a horizontal section 131, 132 extending rearward from the foot. Back legs 136, 133 connect respectively at the base of each to the horizontal sections 131, 132 of the front legs 129, 130. Back legs 136, 133 are connected brace 138. Each back leg 136, 133 extends upwardly and is inclined forwardly, terminating in an upper horizontal section 134, 135. The ends of the upper sections 134, 135 are connected by an overhead beam 137.

First and second generally vertical guide rails 141, 143 carry first and second weight carriers 149, 150. Weight carriers 149, 150 ride up and down on the guide rails 141, 143. A weight handle 145 is connected at first and second ends respectively to the first and second carriers. The weight carriers can be loaded with dumbbells as the dumbbell 153. The weight handle 153 is lifted against the weight resistance of the carriers and any weights carried by the carriers.

A first vertical track member 139 is parallel to and spaced from the first guide rail 141. A second such track member 142 is disposed in similar fashion to the second guide rail 143. The guide rails and track members are connected to the horizontal leg sections 134, 135 of the back legs, at their upper ends. The lower ends are connected to the horizontal sections 131, 132 of the front legs. Each of the track members has a vertical slot facing the corresponding guide rail. Ends of the weight handle 145 have first and second guide members 146, 147, that have pegs or fingers 148, 152 that ride in the slots of the track members for safety and stability when lifting and lowering the weight handle 145.

In use of the embodiment of the invention shown in FIG. 10, a plurality of dumbbells are loaded onto the weight carriers 149, 150 to achieve a desired total weight. The exercising person stands in front of the frame 125 and grasps the weight handle 145. Frame 125 is relatively tall so as to permit the exercising person to stand under the overhead beam 137. The exercising person lifts the weight handle 145 against the weight afforded by the dumbbells located on the weight carriers. The exercising person can engage in weight lifting exercises of the type normally accomplished with a barbell. The path of the weight handle is confined to up and down movement, a safety consideration.

What is claimed is:

1. A weight lifting exercise machine for use with dumbbells of the type having end weights connected by a dumbbell bar, comprising:

a frame having a first vertical support member;

said first support member including a vertical guide rail;

a dumbbell weight carrier including a carriage engaging the guide rail for up and down movement of the carrier on the guide rail;

a first dumbbell receptacle connected to the carriage to releasably hold one or more dumbbells;

a second dumbbell receptacle connected to the carriage in back to back relationship to the first dumbbell receptacle on the opposite side of the guide rail;

each dumbbell receptacle including a bracket having a plurality of hook-shaped openings for receipt of a dumbbell bar;

at least one dumbbell removably engaged by a dumbbell receptacle;

a weight handle for engagement by an exercising person;

said frame including an overhead beam connected to the first vertical support member and at least one pulley connected to the overhead beam;

a cable trained over the pulley and connected at a first end to the weight carrier and at a second end to the weight handle so that the weight handle can be moved during an exercise procedure against the weight of the weight carrier and dumbbells carried by the weight carrier.

2. The weight lifting exercise machine of claim 1 including:

a second vertical support member;

said overhead beam connected to the top of the vertical guide rail and the top of the second vertical support member and overhanging the second vertical support member;

said second end of the cable trained over the overhanging end of the overhead beam.

3. The weight lifting exercise machine of claim 2 wherein:

said cable is a main cable, and including a secondary cable and a secondary weight handle;

a secondary pulley connected to the second support member;

a pulley block connected intermediate the first and second ends of the main cable;

said secondary cable connected to the frame at a first end, trained over the pulley block and the secondary pulley, and connected to the secondary weight handle at a second end.

4. A weight lifting exercise machine for use with dumbbells of the type having end weights connected by a dumbbell bar, comprising:

a frame having a first upright support member;

at least one vertical guide rail connected to the frame;

a dumbbell weight carrier including a carriage engaging the guide rail for up and down movement;

a first dumbbell receptacle connected to the carriage to releasably hold one or more dumbbells;

a second dumbbell receptacle connected to the carriage in back to back relationship to the first dumbbell receptacle on the opposite side of the vertical guide rail;

each dumbbell receptacle including a bracket having a plurality of hook-shaped openings for receipt of a dumbbell bar;

at least one dumbbell removably engaged by each dumbbell receptacle;

said frame including a second upright support member located forward of the first one;

an overhead beam connected to the upper ends of the upright support members and overhanging the second upright support member;

a weight handle;

a cable and pulley system that includes at least one pulley assembled to the overhead beam, and a main cable connected at a first end to the carrier and at a second end to the weight handle and trained over the pulley assembled to the overhead beam, so that the weight handle is movable between a first position adjacent the overhanging end of the overhead beam toward a second position away from the overhanging end of the overhead beam, while lifting the carrier on the guide rail upon movement from the first position toward the second position.

5. The weight lifting exercise machine of claim 4 including:

a plurality of pulleys assembled to the overhead beam.

6. The weight lifting exercise machine of claim 5 wherein:

the dumbbell receptacle includes a dumbbell weight basket.

7. The weight lifting exercise machine of claim 5 including:

a horizontal bench support beam;

releasable pivot means engaged between the horizontal bench support beam and the second support member pivotally connecting the horizontal bench support beam to the second support member and extending forward from it whereby the bench support beam is alternatively pivotal to an out-of-the-way position against the second support member or removable away from it, and a bench seat and backrest connected to the bench support beam.

8. The weight lifting exercise machine of claim 5 including:

a secondary cable and a secondary weight handle;

a secondary pulley connected to the second support member toward the lower end thereof;

a pulley block connected intermediate the first and second ends of the main cable;

said secondary cable connected to the frame at a first end, trained over the pulley block and the secondary pulley, and connected to the secondary weight handle at a second end.

9. The weight lifting exercise machine of claim 4 wherein:

said carriage has slide pads of low friction material in confronting relationship to the guide rail to facilitate movement of the carriage on the guide rail.

* * * * *